US007213571B2

(12) United States Patent
Sakaguchi et al.

(10) Patent No.: US 7,213,571 B2
(45) Date of Patent: May 8, 2007

(54) THROTTLE VALVE ARRANGEMENT FOR A CARBURETOR

(75) Inventors: Takeshi Sakaguchi, Natori (JP); James E. Van Allen, Clifford, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/302,885

(22) Filed: Dec. 14, 2005

(65) Prior Publication Data

US 2006/0162694 A1 Jul. 27, 2006

(30) Foreign Application Priority Data

Jan. 21, 2005 (JP) ..... 2005-013570

(51) Int. Cl.
*F02D 9/08* (2006.01)

(52) U.S. Cl. ..... 123/400

(58) Field of Classification Search ..... 123/399, 123/400

See application file for complete search history.

(56) References Cited

U.S. PATENT DOCUMENTS 2,982,275 A * 5/1961 Doman et al. ..... 123/198 DC
3,898,967 A * 8/1975 Bennett et al. ..... 261/39.1
4,003,968 A * 1/1977 Rickert ..... 261/35
4,966,735 A * 10/1990 LoRusso ..... 261/40
6,000,683 A * 12/1999 Van Allen ..... 261/52
6,120,007 A * 9/2000 Grant ..... 261/23.2
6,431,527 B1 8/2002 Suzuki et al.
6,561,496 B2 5/2003 Gliniecki et al.
6,827,337 B2 12/2004 Terakado

* cited by examiner

*Primary Examiner*—Erick Solis
(74) *Attorney, Agent, or Firm*—Reising, Ethington, Barnes, Kisselle, P.C.

(57) ABSTRACT

A carburetor throttle valve actuation assembly for a combustion engine is readily adapted for use as a remote control actuator, a local control throttle actuator, or both together providing an optional choice for the end user. The carburetor has a throttle valve having a shaft journaled to a body for movement about a rotation axis. A slave lever connects rigidly to a distal end of the shaft projecting outward from the body. A connection spaced radially outward from the axis engages the slave lever to a radially projecting swivel member of a local, manually operated, throttle valve actuation assembly. The swivel member rotates in unison with the slave lever about the axis, is spaced axially outward from the shaft and is journaled to a bracket engaged rigidly to the body. Preferably, the connection has a hole in the slave lever. If the remote throttle control actuator is used, a Bowden wire engages to a pin projecting axially outward from the slave lever at the hole. If the local throttle control actuator is used either a cylindrical void carried by the swivel member mates to the pin, or a peg projecting outward from the swivel member and toward the body is inserted into the hole forming the connection that permits axial movement of the slave lever with respect to the swivel member.

24 Claims, 6 Drawing Sheets

THROTTLE VALVE ARRANGEMENT FOR A CARBURETOR

REFERENCE TO RELATED APPLICATION

Applicants claim priority of Japanese Application No. 2005-013570, filed Jan. 21, 2005.

TECHNICAL FIELD

The present invention relates to a throttle valve arrangement for a carburetor and more particularly to a remote and local dual actuating throttle valve arrangement.

BACKGROUND OF THE INVENTION

In a conventional carburetor, a mixing passage through a body of the carburetor mixes and flows a controlled mixture of fuel-and-air into a combustion engine. For controlling the speed of the engine, a rotating throttle valve of a rotary or butterfly type intersects the mixing passage to restrict the volume of fuel-and-air flow to the engine.

A rotary throttle valve is generally a cylinder that seats rotatably and is movable axially, within a cylindrical cavity that intersects the mixing passage. The rotary throttle valve has a through-bore that adjustably aligns with the mixing passage to control flow. A needle of the cylinder projects downward into the through-bore and axially movably into an opposing fuel feed tube of the body to adjustably obstruct an orifice in a wall of the tube that flows liquid fuel into the through-bore. As the rotary throttle valve rotates toward an open position, the through-bore aligns to the mixing passage to increase flow, and simultaneously, the cylinder lifts axially to partially retract the needle from the tube exposing more of the orifice to the through-bore and thus increasing fuel flow.

The butterfly-type throttle valve is generally a pivoting plate disposed in and conforming to the contour of the mixing passage. Like the rotary throttle valve, the butterfly throttle valve controls the amount of fuel-and-air mixture flowing to the engine. Unlike the rotary throttle valve, the butterfly valve does not directly control the amount of liquid fuel entering the air stream.

Both the rotary and butterfly throttle valves, however, have a rotating shaft that projects out of the carburetor body. For some engine applications a lever is attached to this shaft and connected to a Bowden wire or other linkage for a user to remotely rotate the throttle valve. For other applications a lever or knob attached to this shaft is manually grasped and rotated to locally actuate the throttle valve. For instance, a leaf blower utilizing a small two stroke engine may only require local actuation of a throttle valve, and a lawn mower application may require remote actuation.

The cost of manufacturing a wide array of differing parts dependent upon whether an otherwise identical carburetor is remotely or locally actuated and the cost of two subsequent carburetor assembly lines is expensive and time consuming. Yet further, in some applications, it would be advantageous to have the ability to both remotely and locally actuate a carburetor throttle valve that positively and reliably sets the pre-specified engine speeds.

SUMMARY OF THE INVENTION

A throttle valve actuation assembly for a combustion engine carburetor is readily adapted for optional assembly as a remote control throttle actuator or a local control throttle actuator, or for combined assembly and operator optional use as both a remote and local control throttle actuator. The carburetor has a throttle valve having a shaft journaled to a body for movement about a rotation axis between idle and wide open positions. A slave lever connects rigidly to a distal end of the shaft projecting outward from the body. A connection spaced radially outward from the rotation axis connects the slave lever to a radially projecting swivel member of a local, manually operated, throttle valve actuator. The swivel member rotates about the axis, is spaced axially outward from the end of the shaft and is journaled to a bracket fixed to the body. Preferably, the connection has a hole in the slave lever. If the remote throttle control actuator is used with or without use of the local actuator, a Bowden wire engages to a slotted pin projecting axially outward from the slave lever at the hole. If the local throttle control actuator is used, either the pin mates to a cylindrical void carried by the swivel member, or a peg projecting outward from the swivel member and toward the body is inserted into the hole forming the connection.

Preferably, a circumferential positioning interface is carried between the swivel member and the stationary bracket. A detent follower of the circumferential positioning interface is orientated axially adjacent to the stationary bracket and attaches to the swivel member for unitary rotation. When the local throttle valve actuator is operated, the user positively places the throttle valve in pre-established positions via the circumferential positioning interface without concern for the throttle valve wandering due to engine vibration or unintentional bumping of the local throttle valve actuator.

Objects, features, and advantages of this invention include a versatile carburetor capable of being easily and inexpensively interchangeable between a remote and locally actuated throttle valve applications, a base carburetor design requiring fewer parts to meet varying engine applications, a throttle valve that reliably stays in a desired set position without intentional user intervention, and the ability to assemble varying carburetors on the same assembly line with less likelihood of assembly error. Moreover, the throttle valve arrangement is simple in design, robust, allows for easy calibration of rotary-type throttle valves, is durable, rugged and in service has a long and useful life.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENTS

Figure 1:
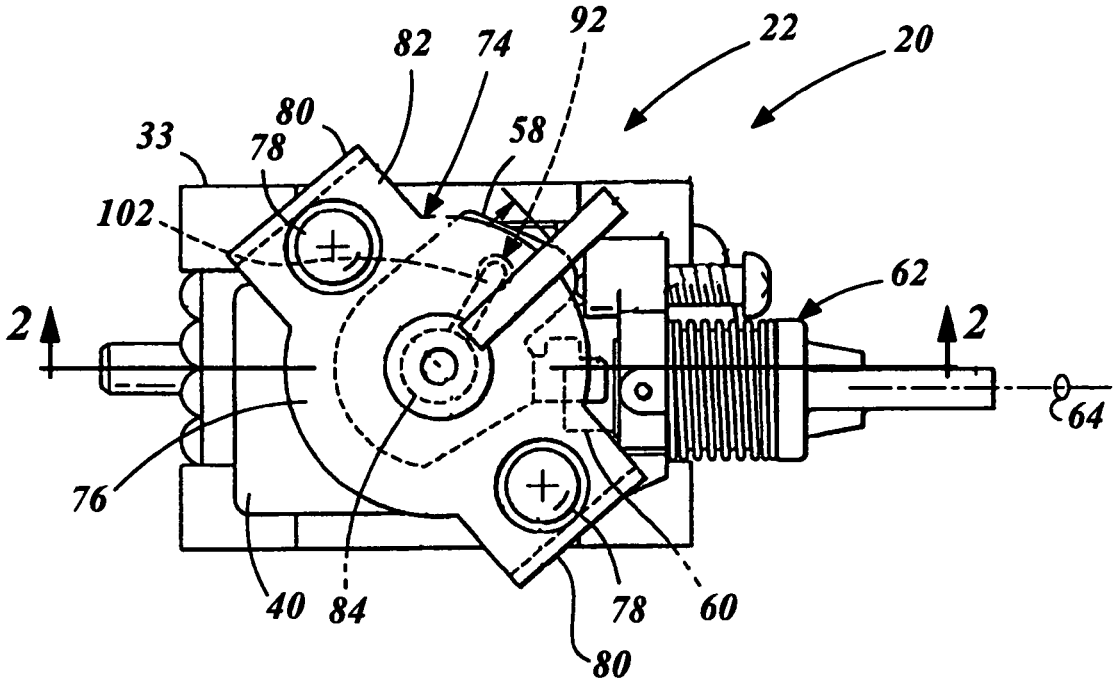
FIG. 1 is a top plan view of a combustion engine carburetor with a throttle valve arrangement embodying the present invention.
Figure 2:
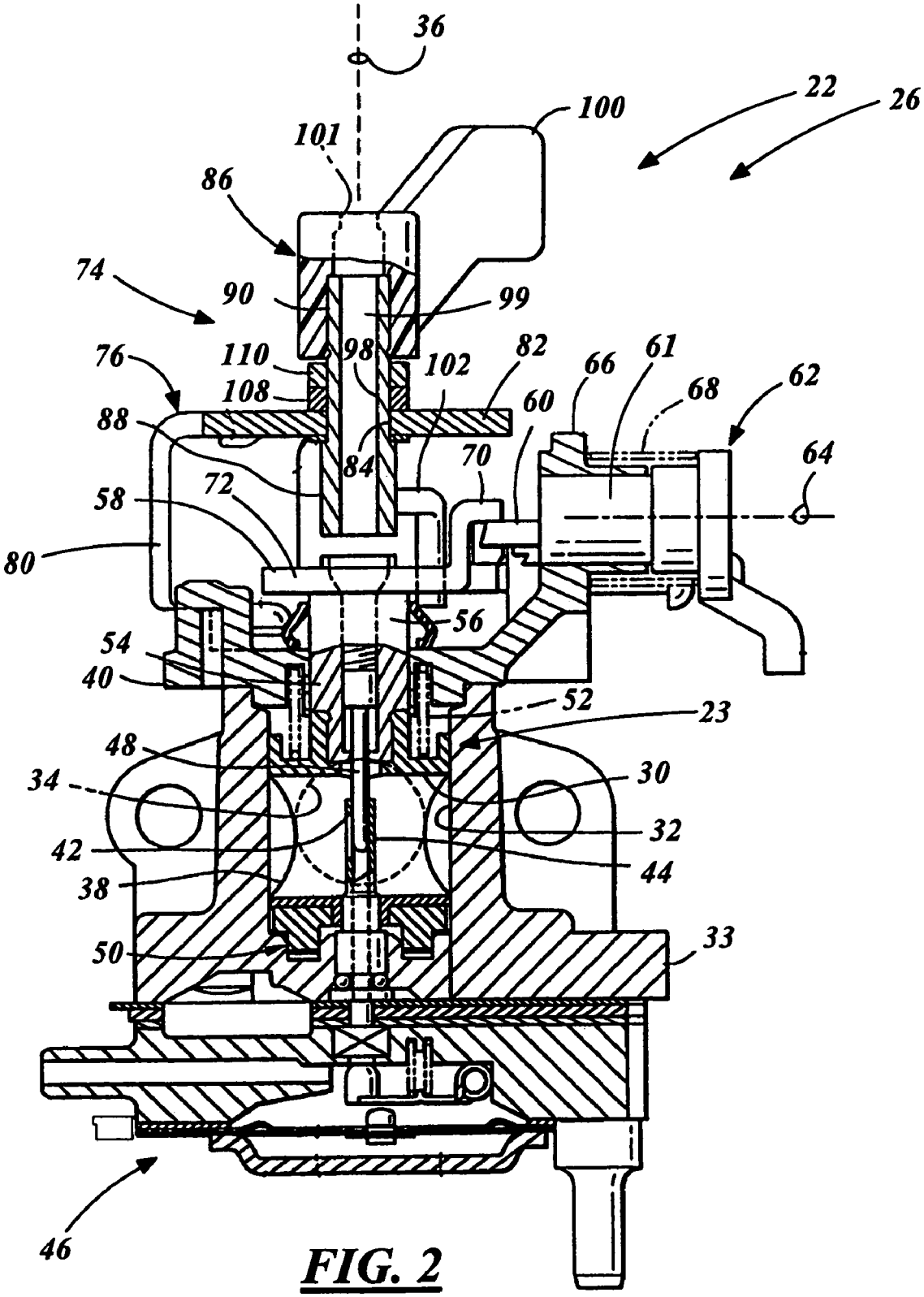
FIG. 2 is a cross section of the carburetor taken along line 2—2 of FIG. 1.
Figure 6:
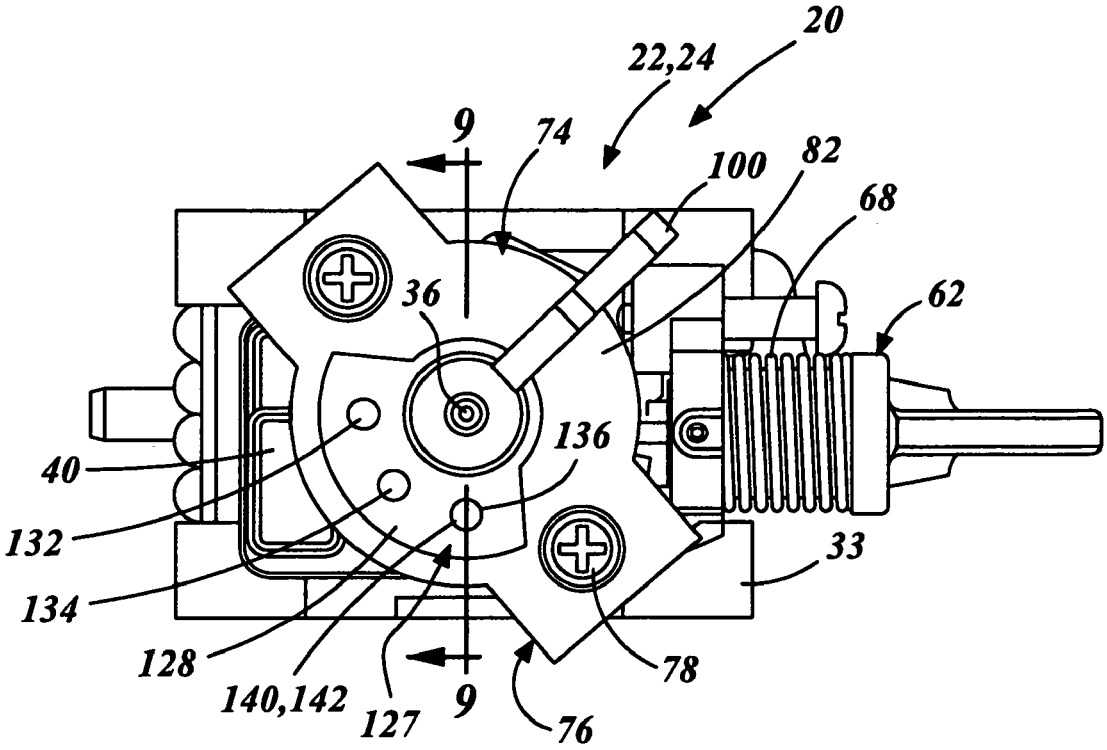
FIG. 6 is a top plan view of the carburetor with the throttle valve in a idle position and illustrating a detent follower that provides resistance against rotation for holding the throttle valve in an idle position.
Figure 7:
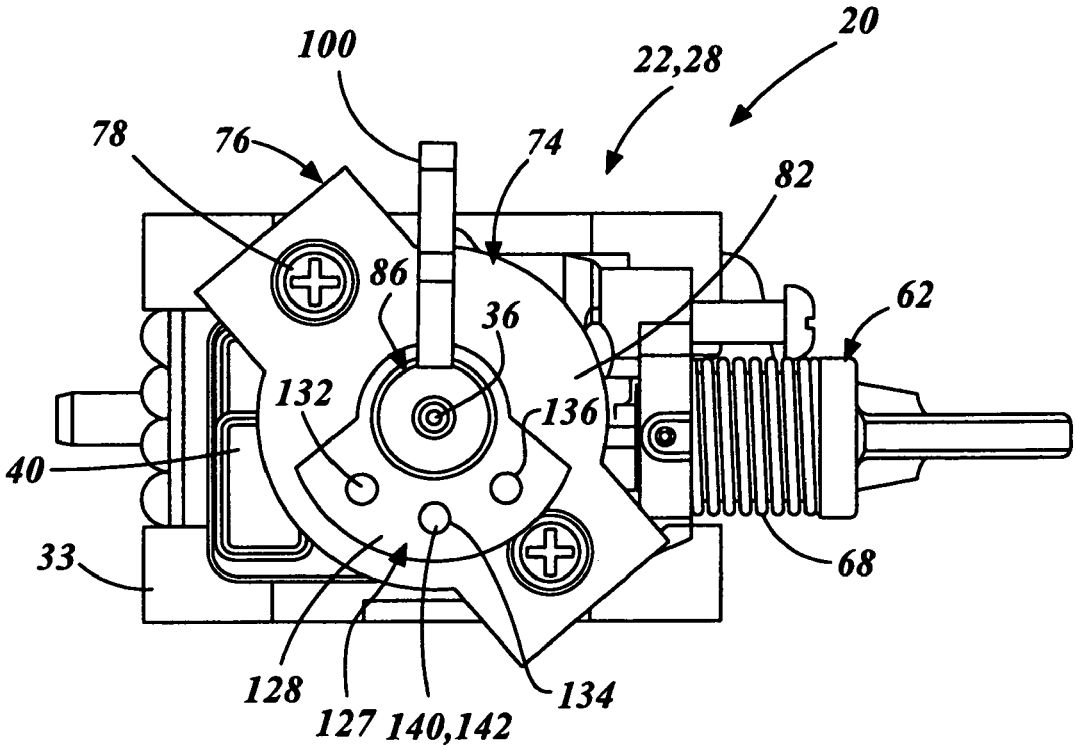
FIG. 7 is a top plan view of the carburetor of FIG. 6 except illustrating the throttle valve in a partially open position.
Figure 8:
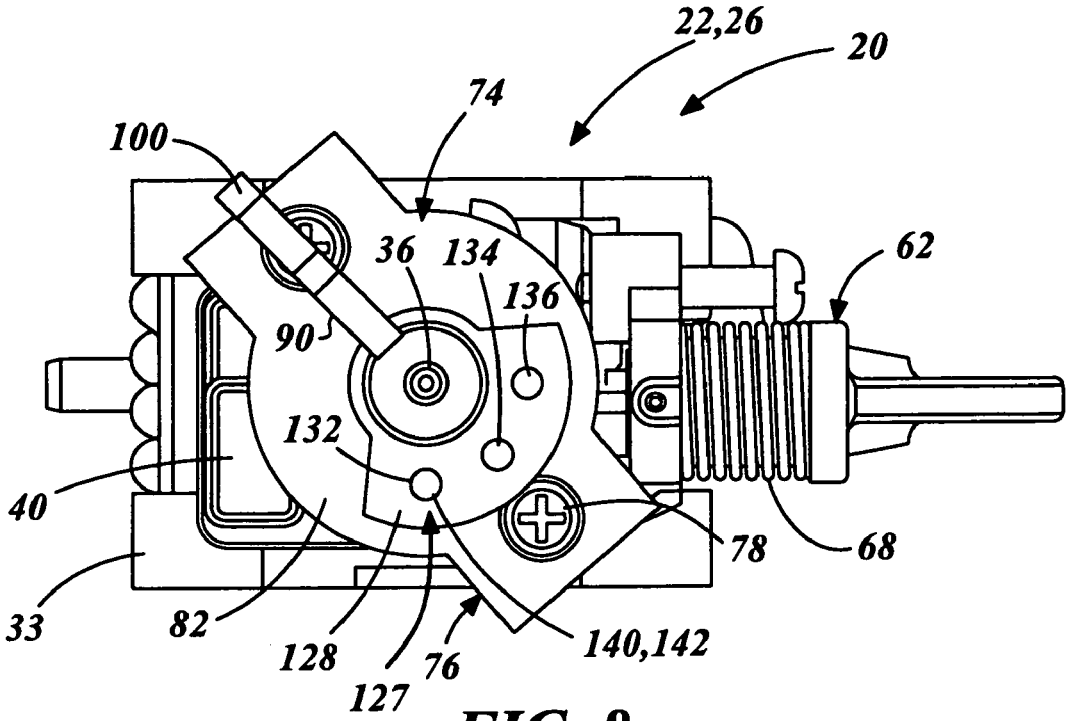
FIG. 8 is a top plan view of the carburetor of FIG. 6 except illustrating the throttle valve in a wide open throttle position.

FIGS. 1 and 2 illustrate a combustion engine carburetor 20 with a throttle valve arrangement 22 of the present invention. A throttle valve 23 of the throttle valve arrangement 22 is preferably a rotary-type commonly used with smaller two stroke engine applications, such as hedge trimmers and leaf blowers that typically require only a closed throttle position 24 (FIG. 6), designating an engine shut-off or slow idle position, and a wide open throttle position 26 (FIG. 8), designating maximum engine speed or power. One skilled in the art, however, could apply any type of throttle valve to the throttle valve arrangement 22 including the known butterfly-type which typically has a valve plate in the mixing passage 34 attached to a rotatable shaft extending transverse across the mixing passage. The carburetor 20 can also be applied to four stroke engines and applications having intermediate throttle valve position(s) 28 (FIG. 7) for adjusting engine speed and power output.

The throttle valve 23 has a generally cylindrical throttle 30 (see FIG. 2) rotatably received in a cylindrical cavity 32 of a body 33 that intersects a fuel-and-air mixing passage 34 through the body 33. The rotary throttle 30 rotates about an axis 36 and is operatively moveable axially or vertically within the cylindrical cavity 32 as it moves between the closed or idle position 24 and the wide open throttle position 26. A throttling bore 38 extends transversely through the rotary throttle 30 and communicates operatively with the fuel-and-air mixing passage 34. The throttling bore 38 is substantially perpendicular to the axis 36 and aligns so that when the carburetor 20 is in the wide open throttle position 26 the throttling bore 38 is in substantially full communication with the fuel-and-air mixing passage 34.

During assembly, the rotary throttle 30 preferably is inserted into the cylindrical cavity 32 from above, then a retaining cover 40 is secured and sealed to the body over the cavity 32. The rotary throttle 30 moves vertically to control the amount of liquid fuel entering the throttling bore 38 and the fuel-and-air mixing passage 34 from a side orifice 42 of a fuel feed tube 44. The feed tube 44 is located concentrically to the axis 36 and projects upward from a fuel supply and metering system 46 of the carburetor 20. A downward projecting needle 48 of the rotary throttle valve 23 is attached to the rotary throttle 30 and moves vertically within the fuel feed tube 44 to adjustably obstruct the orifice 42 and thus adjust fuel flow. At wide open throttle position 26, the distal end of the needle 48 typically is located above the orifice 42 and generally does not obstruct fuel flow into the throttling bore 38. At the closed position 24, preferably the needle 48 is fully inserted into the feed tube 44 and obstructs all, or nearly all, fuel flow through the orifice 42, thus preferably acting as an engine shut down feature for at least small engine applications. For other engine applications at the idle position 24 the needle 48 greatly reduces the fuel flow rate to that needed for proper idling of the operating engine.

A cam relationship 50 between a substantially annular bottom face of the rotary throttle 30 and a substantially annular bottom of the cylindrical cavity 32 causes the rotary throttle 30 and needle 48 to move vertically when it rotates about the axis 36. The annular bottom forms a cam follower carried by the body 33 and the annular bottom face of the rotary throttle 30 is a cam surface. Since the rotary throttle 30 moves axially, the axial length of the cylindrical cavity 32 is generally greater than the axial length of the rotary throttle 30. Preferably, when the rotary throttle valve 23 is in the closed position 24, the rotary throttle 30 is vertically furthest away from the cover 40, and conversely, when in the wide open throttle position 26 it is closest to the cover. Preferably, a coiled spring 52 disposed substantially concentrically to the axis 36 is compressed between the cover 40 and the rotary throttle 30 in the cylindrical cavity 32. The spring force yieldably biases the rotary throttle 30 and needle 48 toward the cavity bottom and may cause rotation toward the closed position 24.

A shaft 54 of the rotary throttle valve 23 projects concentrically axially upward from the rotary throttle 30 and through the body cover 40 to a distal end 56. A slave lever 58 projects radially outward from the distal end 56 to engage a cam 60 of a starter device 62 having a cylindrical body 61 with a rotational centerline 64 oriented substantially perpendicular to the rotation axis 36 of the throttle valve 23. A support bracket 66 of the cover 40 projects substantially unitarily upward to rotatably carry the body 61 of the starter device 62. A coiled return spring 68 rotatably yieldably urges the body 61 and cam 60 to an initial inoperative position. The cam 60 underlies an engagement claw 70 bent from a substantially planar portion 72 of the slave lever 58 so that the claw 70 is engaged and moved by the cam body 61 of the starter 62 as the cam body 61 rotates about the centerline 64 away from its initial position.

The engagement claw 70 and cam 60 are axially (with respect to axis 36) or vertically separated from each other so that they will not engage each other by the rotational movement of the slave lever 58 during normal use. However, when the slave lever 58 is at the fully closed position 24, and by rotating the starter body 61 through a certain angle, the cam 60 lifts the slave lever 58 by a prescribed axial distance via the engagement claw 70. When the starter body 61 is rotated all the way to a prescribed limit determined by a stopper (not shown), the slave lever 58, that is in the lifted state, is turned in the valve opening direction by a prescribed rotational amount or degree. Thereby, the amount of fuel supply and the amount of valve opening area are both increased to provide the proper ratio and quantity of fuel-and-air mixture for cold starting an engine.

In addition to the rotary throttle valve 23, the slave lever 58, and the starter device 62, the throttle valve arrangement 22 preferably has a local throttle valve actuator 74. Like the throttle valve 23 and the slave lever 58, the throttle valve actuator 74 generally operates by rotation about the rotation axis 36 of the throttle valve 23. Unlike the rotary throttle valve 23 and the slave lever 58, the local throttle valve actuator 74 does not move axially with respect to the body 33 and cover 40 of the carburetor 20.

The local throttle valve actuator 74 has a bracket 76 secured preferably to the body cover 40 by two threaded fasteners 78 generally at opposite legs 80 of the bracket 76. A bridging segment 82 of the bracket 76 extends between the legs 80 and spans over the distal end 56 of the shaft 54 and the slave lever 58. The legs 80 are sufficiently spaced apart from one-another so as not to obstruct free rotational movement of the slave lever 58. Journaled to the bridging segment 82 and extending rotatably through a hole 84 in the bridging segment 82 is a swivel member 86 having a radially projecting lower end 88 located below the bridging segment 82 and an opposite radially projecting upper end 90 projecting axially above the bridging segment 82. A coupling 92, connects the lower end 88 of the swivel member 86 to the planar portion 72 of the slave lever 58 and preferably accommodates axial movement of the slave lever 58.

Figure 3:
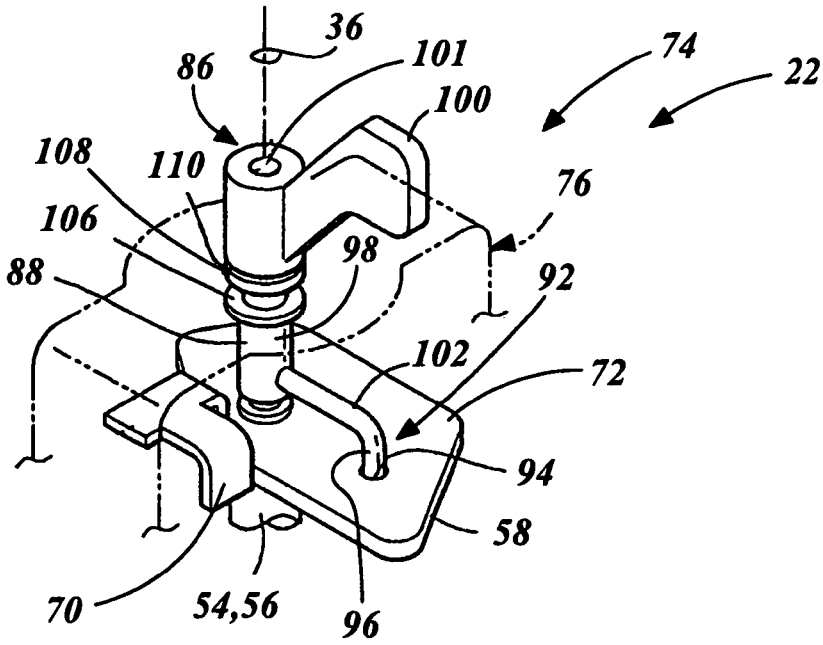
FIG. 3 is a perspective view of a local throttle valve actuator of the throttle valve arrangement.

As best illustrated in FIGS. 2 and 3, the planar portion 72 of the slave lever 58 is located in an imaginary plane orientated substantially perpendicular to the rotation axis 36. A hole 94 of the lost motion coupling 92 is in the planar portion 72 and is located appreciably radially outward from the rotation axis 36 and distal end 56. For carburetor applications not requiring a Bowden cable for remote throttle valve actuation, the lost motion coupling 92 has a peg 96 that projects preferably unitarily downward from the lower end 88 of the swivel member 86 and through the hole 94 for rotational sequencing or co-rotation between the slave lever 58 and the local throttle valve actuator 74. Because the slave lever 58 moves axially, up and down, a prescribed distance, the axial clearance generally between the slave lever 58 and the lower end 88 of the swivel member 86 must be equal to or greater than the prescribed distance. Similarly, the axial length of the peg 96 must be greater than the prescribed distance so that the peg 96 does not release from the slave lever 58 when the rotary throttle valve 23 rotates and lowers axially to the closed position 24.

Preferably, the swivel member 86 has a tube or hollow cylinder 98 that has the lower and upper ends 88, 90 and substantially midway is journaled for rotation to the bridging segment 82. The cylinder 98 carries an axially extending access bore 99 for insertion of a tool (not shown) to threadably adjust the needle 48 with respect to the orifice 42. The cylinder 98 is preferably metallic for strength. Preferably, press fitted on the upper end 90 of the hollow cylinder 98 is a radially projecting handle 100 for manual rotation of the throttle valve 23 which is preferably made of injection molded plastic. For receipt of the needle adjustment tool, the handle 100 has a bore 101 communicating co-axially with the access bore 99.

Figure 9:
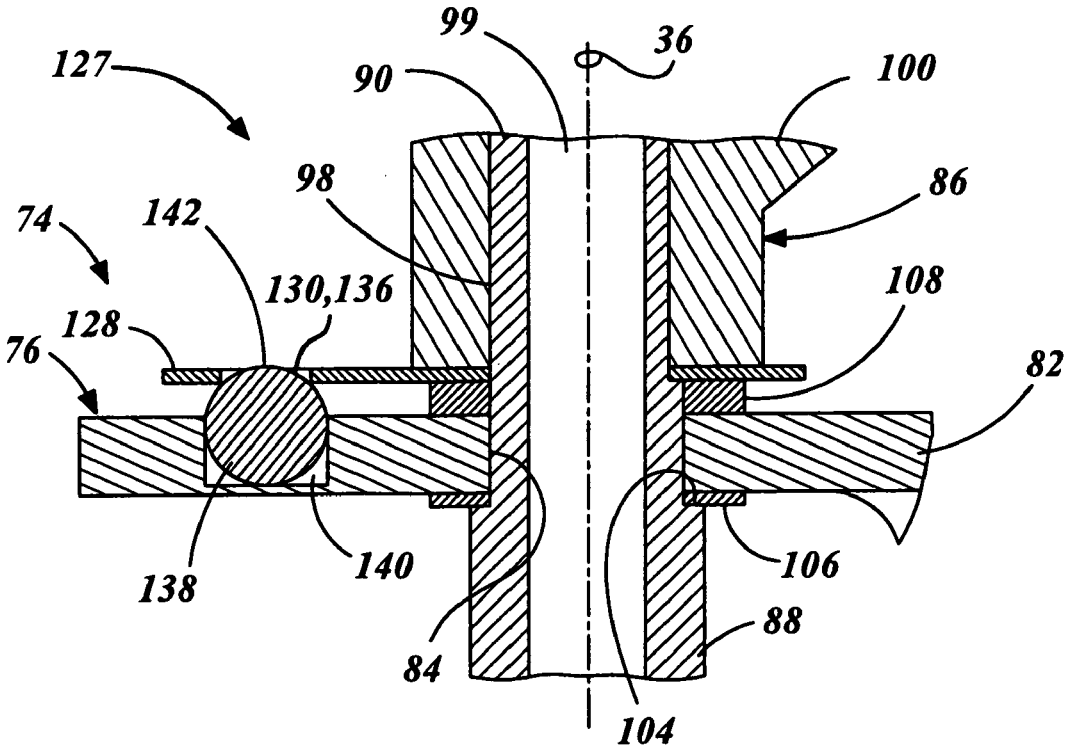
FIG. 9 is a cross section of the detent follower taken along line 9—9 of FIG. 6.

Engaged to and projecting radially outward from the lower end 88 of the cylinder 98 is a bent leg 102 that has the peg 96. Ideally, the lower end 88 has a diameter slightly greater than the upper end 90 and thus has an upward facing annular shoulder 104 (as best shown in FIG. 9). For smooth rotation and to prevent wear, a metallic washer 106 of the local throttle valve actuator 74 is located between the bridging segment 82 and the annular shoulder 104. Also located concentrically to the axis 36 and located axially between the bridging segment 82 and the handle 100 is a spacer or collar 108. A C-clip 110 resiliently snap fits to the cylinder 98 for axial retention of the collar 108. A frictional resistance produced between the collar 108, washer 106 and bracket 76 can retain the handle 100 at a desired angular position and against the smaller biasing force of the compression spring 52.

Figure 4:
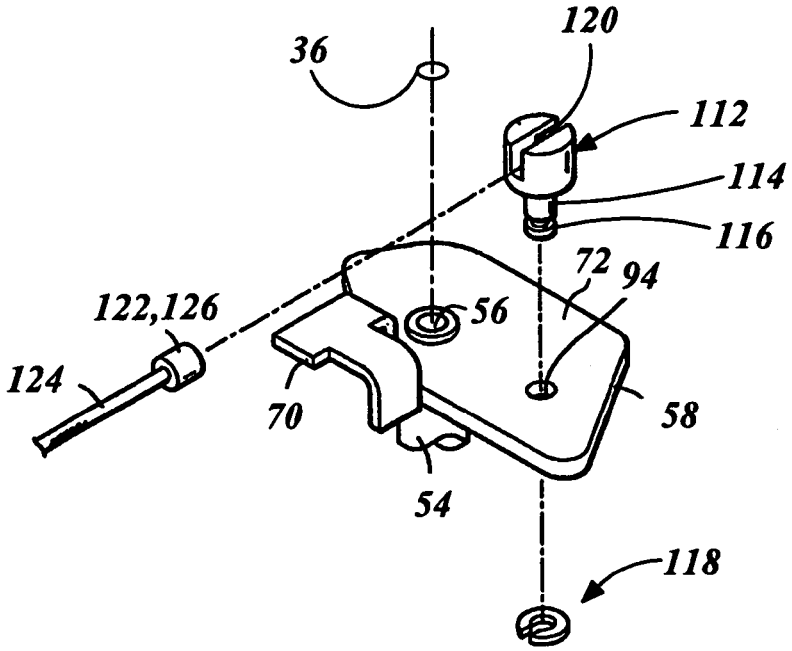
FIG. 4 is an exploded perspective view of a slave lever connected to a Bowden wire for remote actuation of a throttle valve of the throttle valve arrangement.
Figure 5:
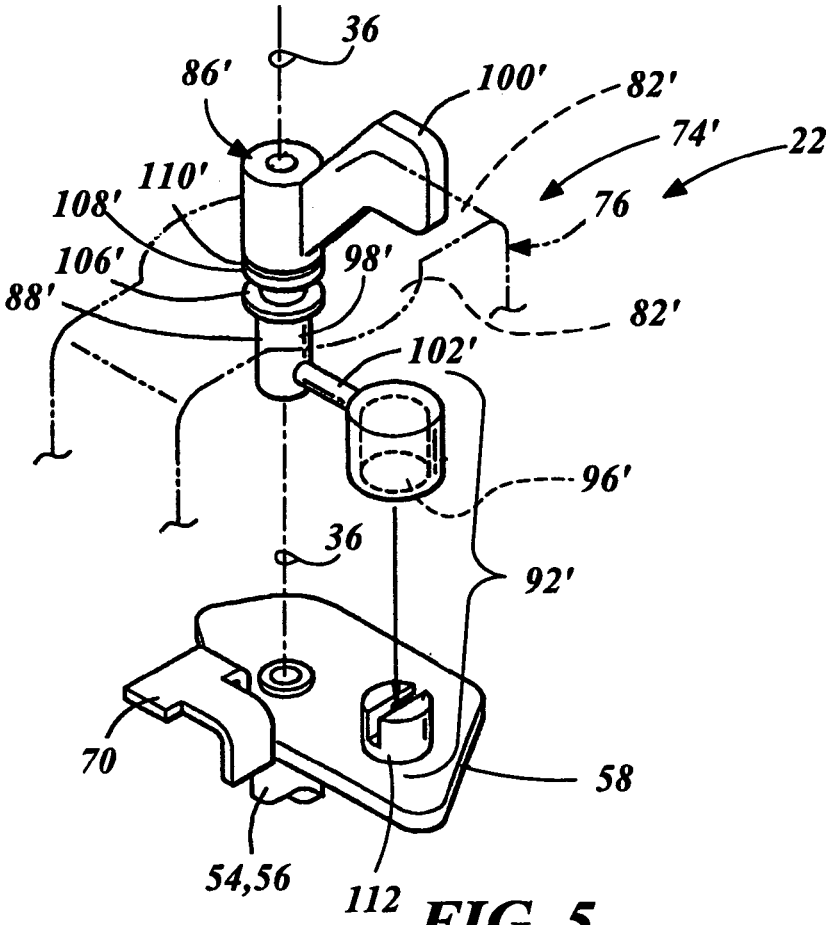
FIG. 5 is an exploded perspective view of a modified local throttle valve actuator connected to a slave lever that is also connected to the Bowden wire for both local and remote actuation of the throttle valve of the throttle valve arrangement.

As best illustrated in FIG. 5, an optional and interchangeable arrangement replaces the peg 96 of the lost motion coupling 92 with an inverted cylindrical void 96' carried by the swivel member 86' or leg 102' that axially receives an upward projecting, cylindrical, pin 112 having a downward projecting pin 114 (FIG. 4) extending through the hole 94 of the lost motion coupling 92'. The pin 114 preferably carries a continuous groove 116 for receipt of a C-clip 118 for reliably retaining the pin 112 on the slave lever 58. Alternatively, the pin 112 could be snap fitted into the hole 94 without use of the C-clip 118. The depth of the cylindrical void 96' is greater than the upward projecting distance of the pin 112. This allows the common slave lever 58 to axially rise with respect to the swivel member 86' as the throttle valve 23 moves in the opening direction thereby accommodating axial movement of the slave lever.

In applications not necessarily requiring the local throttle valve actuator 74', the pin 112 also has a diametrically extending slot 120 for receipt of a distal end 122 of a Bowden wire 124 for remote actuation and having an enlarged head 126 as typically known in the art. Preferably, the pin 112 is snap locked rotatably in the hole 94 so that when the Bowden wire 124 is pulled and the throttle valve 23 rotates in the open direction against the biasing force of the coiled compression spring 52, the pin 112 will also rotate slightly in the hole 94 to prevent kinking or binding of the cable 124, thus the coupling 92' accommodates both rotational and axial motion. Preferably, the depth of the slot 120 is greater than the axial movement of the throttle valve 23 allowing for connecting of both the local throttle valve actuator 74' and the Bowden wire 124 for remote actuation.

As best illustrated in FIGS. 6–9, a circumferential positioning interface 127 of the throttle valve arrangement 22 is generally carried between the swivel member 86 and the bridging segment 82 of the bracket 76. The interface 127 is preferably added to throttle valve arrangement 22 of the carburetor 20 to assist or replace the frictional resistance between the collar 108, washer 106 and bracket 76 that generally resists the closure biasing force of the spring 52. The circumferential positioning interface 127 has a generally pie shaped detent follower or steel spring plate engaged 128 engaged to the swivel member 86 for unitary rotation about the axis 36. The detent follower 128 carries a plurality of holes, indents or recesses that are strategically spaced circumferentially about the axis 36 to designate desired operating speeds of the engine when they selectively receive a cam surface 142 of the carried preferably by a ball or ball bearing 138 of the interface 127 generally trapped in a socket 140 of the bridging segment 82. As illustrated in FIGS. 6–9, a first recess 132 designates wide open throttle position 26 and thus an engine running at maximum speed or power, a second recess 134 designates a partially open throttle valve position 28 and thus an engine running at partial and a possibly quieter speed or partial power, and a third recess 136 designates the closed throttle valve position 24 thus engine shut-down.

When, for instance, an engine of a leaf blower is operating at maximum power, the ball bearing 138 of the circumferential positioning interface 127 of the local throttle valve actuator 74 projects in-part into the third recess 132. Regardless of the biasing force of the compression spring 52, vibrational forces of the running engine or other extenuating forces, the throttle valve 23 will remain in the wide open position 26 until the operator manually applies a greater force to the handle 100 that causes the follower or spring plate 128 to rotate and resiliently flex outward or upward causing disengagement of the ball 138 from the third recess 132. Continued rotation of the handle 100 causes the ball 138 to slide across the follower 128 of the interface 127 until the next recess 134 is encountered positively placing the throttle valve 23 into the adjacent or intermediate pre-specified position. When the ball 138 is placed in the first recess 136 designating the closed position 24 of the throttle valve 23, the engine will reliably shut-down without concern that the throttle valve would be slightly open unintentionally, which would prevent or pro-long engine shut-down.

Figure 10:
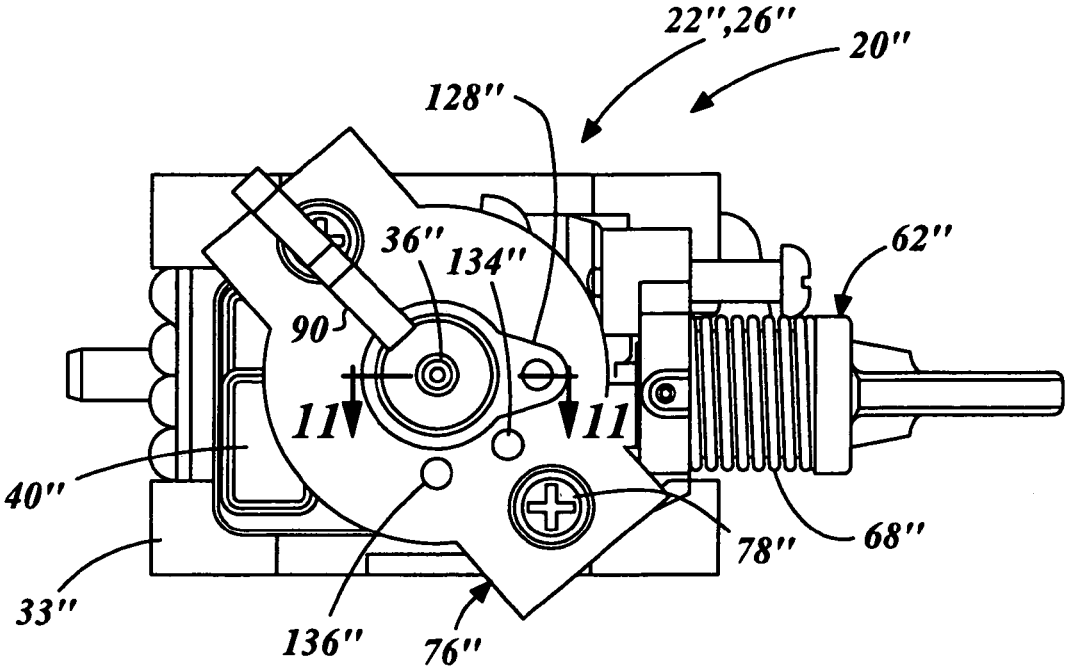
FIG. 10 is a top plan view of the carburetor illustrating a modified detent follower that provides resistance against rotation of the throttle valve and showing the throttle valve in the wide open throttle position.
Figure 11:
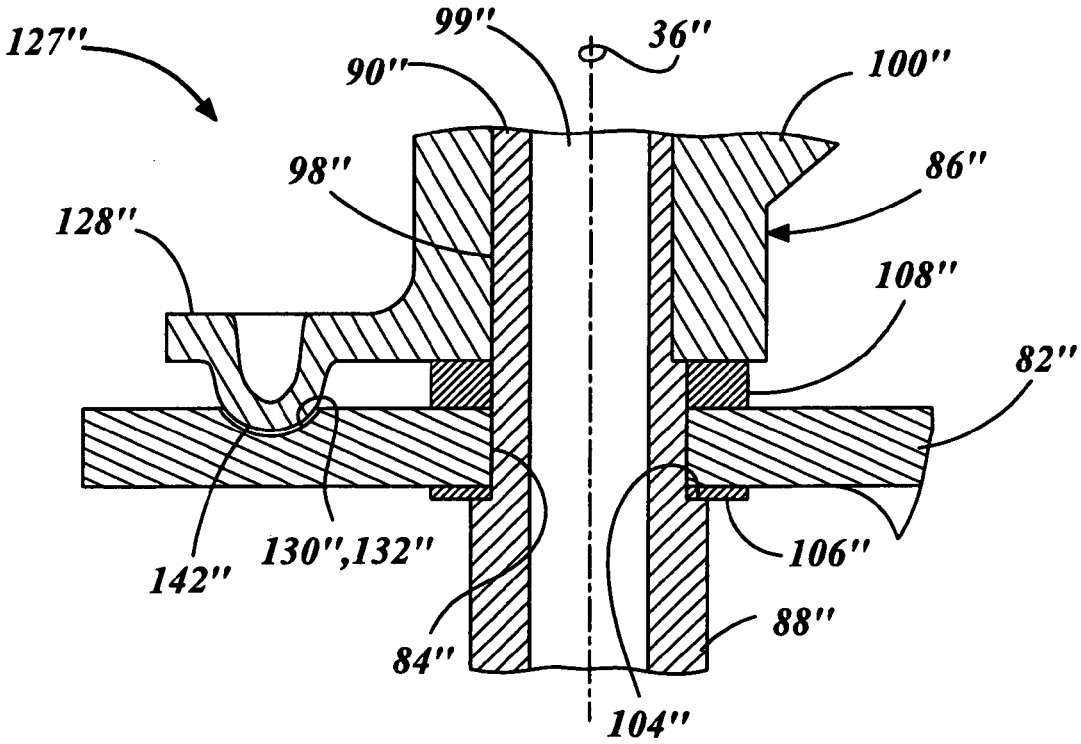
FIG. 11 is a cross section of the detent follower taken along line 11—11 of FIG. 10.

Although the detent follower 128 is illustrated having recesses 130 that communicate generally through the follower 128, other detent followers can be applied to the local throttle valve actuator that would provide the desired positive placement of the throttle valve in pre-specified positions. One such detent follower is disclosed in U.S. Pat. No. 6,561,496 that is incorporated herein by reference in its entirety. Another detent follower is illustrated in FIGS. 10 and 11 wherein like elements have like numerals except for the addition of a subsequent double prime symbol. As modified, a circumferential positioning interface 127" has a cam follower 128" that does not utilize a steel spring plate or ball bearing to carry a convex cam surface. Instead, the cam follower 128" is preferably molded as one unitary piece with the swivel member 86". This one piece is preferably made of injection molded plastic or similar economical material providing the cam follower 128" with a resilient flexibility that yieldably biases the cam follower into pre-defined circumferential positions with respect to the axis 36". A convex cam surface 142" carried by the cam follower 128" faces downward and generally replaces the ball bearing 138 as previously illustrated in FIGS. 6–9, thus greatly reducing the number of required parts during assembly. Accordingly, three recesses or holes 130" are circumferentially spaced about the axis 36" and opened upward or outward in the bridging segment 82" to selectively receive the cam surface 142". A recess 132" of the recesses 130" is orientated for the wide open throttle position, a recess 134" is orientated for an intermediate throttle valve position and a recess 136" is orientated for an throttle valve idle position.

While the forms of the invention herein disclosed constitute presently preferred embodiments, many others are possible. It is not intended herein to mention all the possible equivalent forms, modifications or ramifications of the invention. It is understood that terms used herein are merely descriptive, rather than limiting, and that various changes may be made without departing from the spirit or scope of the invention as defined by the following claims.

The invention claimed is:

1. A throttle valve arrangement for a combustion engine carburetor comprising:

a carburetor body;

a shaft of a throttle valve supported rotatably by the body of the carburetor for rotation about an axis, the shaft projecting outward from the body;

a slave lever connected to and extending generally radially from the shaft for rotation therewith; and a local throttle valve actuator having:

a bracket engaged removably to the body having a hole spaced axially from and aligned concentrically to the projecting shaft, a swivel member engaged rotatably to the bracket and oriented co-axially to the shaft, and a disengageable coupler carried between the swivel member and the slave lever and spaced radially outward from the axis.

2. The throttle valve arrangement set forth in claim 1 further comprising a Bowden wire engaged to the slave lever for remote rotation of the throttle valve.

3. The throttle valve arrangement set forth in claim 1 further comprising:

a hole of the disengageable coupler in the slave lever; and a peg of the disengageable coupler projecting from the swivel member, toward the body, and into the hole.

4. The throttle valve arrangement set forth in claim 1 further comprising:

a pin of the disengageable coupler projecting outward from the slave lever axially and away from the body; and a cylindrical void of the disengageable coupler carried by the swivel member and opening toward the body for receipt of the pin.

5. The throttle valve arrangement set forth in claim 4 further comprising:

the pin mounted rotatably to the slave lever; and a Bowden wire engaged to the pin for remote rotation of the throttle valve.

6. The throttle valve arrangement set forth in claim 5 wherein the pin is cylindrical and is in rotational relationship to the slave lever.

7. The throttle valve arrangement set forth in claim 6 further comprising a diametrically extending slot in the pin opening outward with respect to the body for receipt of an enlarged end of the Bowden wire.

8. The throttle valve arrangement set forth in claim 4 wherein the throttle valve is a rotary type, the shaft is constructed and arranged to move axially and the coupling is a lost motion coupling wherein the pin moves axially with respect to the cylindrical void as the throttle valve rotates.

9. The throttle valve arrangement set forth in claim 3 wherein the throttle valve is a rotary type, the shaft is constructed and arranged to move axially and the coupling is a lost motion coupling wherein the peg moves axially in the hole as the throttle valve rotates.

10. The throttle valve arrangement set forth in claim 1 further comprising a circumferential positioning interface carried between the swivel member and the bracket for positive angular placement of the swivel member with respect to the axis.

11. The throttle valve arrangement set forth in claim 10 further comprising a detent follower of the circumferential positioning interface engaged to the swivel member for unitary rotation and being resiliently flexible in an axial direction for yieldable interaction with the bracket.

12. The throttle valve arrangement set forth in claim 11 further comprising the circumferential positioning interface having at least one protruding cam surface carried by the bracket, and at least one recess carried by the detent follower for receipt of a respective one of the at least one cam surface.

13. The throttle valve arrangement set forth in claim 12 wherein the at least one protruding cam surface is only one and is carried by a ball projecting out of a socket in the bracket.

14. The throttle valve arrangement set forth in claim 11 further comprising a convex cam surface carried by the detent follower and facing toward the bracket for yieldable receipt into at least one recess in the bracket.

15. The throttle valve arrangement set forth in claim 14 wherein the detent follower projects radially outward from the swivel member and is formed to the swivel member as a unitary injection molded plastic piece.

16. A throttle valve arrangement integrated into a body of a combustion engine carburetor, the throttle valve arrangement comprising:

an axis of rotation;

a throttle valve having a shaft supported rotatably by the body for rotation about the axis, the shaft having a distal end projecting outward from the body;

a slave lever connected rigidly to the distal end, and projecting radially outward from the shaft, the slave lever having a planar portion disposed perpendicular to the axis and a hole spaced radially outward from the shaft for optional engagement of a Bowden wire for remote actuation of the throttle valve and for optional axial engagement of a local, manual, throttle valve actuator; and the throttle valve actuator has a bracket engaged rigidly to the body and a swivel member engaged rotatably to the bracket along the axis of rotation and constructed and arranged to connect to the slave lever at the hole.

17. The throttle valve arrangement set forth in claim 16 wherein the swivel member does not move axially with respect to the body.

18. The throttle valve arrangement set forth in claim 17 wherein the throttle valve is a rotary throttle valve and the slave lever moves axially with respect to the body.

19. The throttle valve arrangement set forth in claim 18 further comprising a cylindrical pin mounted in the hole and projecting axially away from the body, the pin having a slot for receipt of the Bowden wire and wherein the pin is optionally received by the swivel member.

20. A throttle valve actuator of a carburetor throttle valve arrangement for local operation of a throttle valve of the throttle valve arrangement having a rotation axis, the throttle valve actuator comprising:

a bracket constructed and arranged to rigidly engage a carburetor body over a slave lever of the throttle valve arrangement that rotates about the rotation axis;

a swivel member engaged rotatably to the bracket and oriented co-axially with the rotating throttle valve of the carburetor throttle valve arrangement; and a coupling spaced radially outward from the axis and constructed and arranged between the slave lever and the swivel member.

21. The throttle valve actuator set forth in claim 20 further comprising a peg of the coupling projecting from the swivel member toward the body for receipt in a hole of the coupling in the slave lever.

22. The throttle valve actuator set forth in claim 20 further comprising:

a cylindrical void of the coupling in the swivel member opening axially toward the body; and a pin of the coupling projecting axially from the slave lever and into the cylindrical void.

23. A throttle valve arrangement for a combustion engine carburetor having a body, a fuel-and-air mixing passage through the body, a cylindrical cavity communicating transversely through the fuel-and-air mixing passage and along an axis and a fuel feed tube supported by the body and projecting co-axially with respect to the axis into the fuel-and-air mixing passage, the throttle valve arrangement comprising:

a rotary throttle valve having a rotary throttle located rotatably in the cylindrical cavity;

a cam relationship between the body and the rotary throttle for moving the rotary throttle axially during rotation;

a through-bore of the rotary throttle that substantially aligns to the fuel-and-air mixing passage when the throttle valve is in a wide open throttle position and is substantially mis-aligned when in a closed position;

a needle of the rotary throttle valve supported by the rotary throttle and projecting adjustably co-axially into the fuel feed tube to variably obstruct a fuel feed orifice of the fuel feed tube in the through-bore;

a shaft of the rotary throttle valve projecting co-axially from the rotary throttle, out of the body and to a distal end;

a slave lever engaged to the distal end;

a bracket engaged to the body and bridging over the distal end and the slave lever;

a swivel member journaled to the bracket and disposed co-axially to the shaft; and a coupling spaced radially from the axis and oriented between and carried by the slave lever and the swivel member, and constructed and arranged so that the swivel member rotates with the slave lever while the slave lever moves axially without axial movement of the swivel member.

24. The throttle valve arrangement set forth in claim 23 wherein the needle is threaded to the rotary throttle and is exposed for rotational adjustment through a concentrically oriented access bore in the swivel member.

* * * * *